US010208645B2

(12) United States Patent
Gehrlein et al.

(10) Patent No.: US 10,208,645 B2
(45) Date of Patent: Feb. 19, 2019

(54) MIXING CHAMBER FOR MIXING AN ADDITIVE IN AN EXHAUST SYSTEM OF AN INTERNAL COMBUSTION ENGINE

(71) Applicant: TENNECO GMBH, Edenkoben (DE)

(72) Inventors: Joachim Gehrlein, Rheinzabern (DE); Frank Terres, Frankeneck (DE); Andreas Lang, Hassloch (DE)

(73) Assignee: TENNECO GMBH, Edenkoben (DE)

( * ) Notice: Subject to any disclaimer, the term of this patent is extended or adjusted under 35 U.S.C. 154(b) by 570 days.

(21) Appl. No.: 14/763,998

(22) PCT Filed: Aug. 5, 2014

(86) PCT No.: PCT/EP2014/066864
§ 371 (c)(1),
(2) Date: Jul. 28, 2015

(87) PCT Pub. No.: WO2015/018849
PCT Pub. Date: Feb. 12, 2015

(65) Prior Publication Data

US 2015/0354432 A1 Dec. 10, 2015

(30) Foreign Application Priority Data

Aug. 5, 2013 (DE) ..... 20 2013 006 962 U

(51) Int. Cl.
*B01F 5/04* (2006.01)
*F01N 13/08* (2010.01)
(Continued)

(52) U.S. Cl.
CPC ..... *F01N 13/08* (2013.01); *B01F 3/04049* (2013.01); *B01F 5/0057* (2013.01);
(Continued)

(58) Field of Classification Search
CPC ..... B01F 3/04049; B01F 5/04; B01F 5/0451; B01F 2005/0014; B01F 2005/0091;
(Continued)

(56) References Cited

U.S. PATENT DOCUMENTS 9,157,358 B2 10/2015 Beckmann et al.
2008/0256931 A1 10/2008 Kawakita et al.
(Continued)

FOREIGN PATENT DOCUMENTS

CN 101469627 A 7/2009
DE 10 2010 049 018 A1 4/2012
(Continued)

*Primary Examiner* — Marc C Howell
(74) *Attorney, Agent, or Firm* — Hudak, Shunk & Farine Co., LPA

(57) ABSTRACT

A mixing chamber for mixing an additive in an exhaust system of an internal combustion engine, having a single-part or multi-part housing which has an entry opening for exhaust gas having a flow cross-section and having a central entry axis, and which has, arranged downstream of the entry opening, an exit opening for exhaust gas having a flow cross-section and having a central exit axis. A flow-guiding element is arranged within the housing between the two openings, wherein the flow-guiding element is tubular and forms at least one channel having a channel axis, said channel having an inlet and having an outlet, via which the entire exhaust gas stream is guided, in a flow direction parallel to the channel axis, to the outlet having an outlet cross-section, and the flow direction deviates relative to the central exit axis by an angle a of between 20° and 80°. The mixing chamber is to be designed and arranged in such a way that, with a reduced overall length, an improved distribution of the mixture of exhaust gas and additive over the substrate surface is achieved and at the same time deposits of the additive are avoided. A downstream substrate is provided adjacent to the outlet in the direction of the central
(Continued)

exit axis, the downstream substrate having a substrate cross-section that corresponds to the outlet cross-section.

20 Claims, 4 Drawing Sheets

(51) Int. Cl.

| | |
|---|---|
| ***B01F 5/00*** | (2006.01) |
| ***B01F 3/04*** | (2006.01) |
| ***F01N 3/20*** | (2006.01) |
| ***F01N 3/28*** | (2006.01) |

(52) U.S. Cl.
CPC ..... *B01F 5/04* (2013.01); *B01F 5/0451* (2013.01); *F01N 3/206* (2013.01); *F01N 3/2892* (2013.01); *B01F 2005/0011* (2013.01); *B01F 2005/0014* (2013.01); *B01F 2005/0091* (2013.01); *B01F 2215/0422* (2013.01); *F01N 2240/20* (2013.01); *F01N 2470/18* (2013.01); *F01N 2610/00* (2013.01)

(58) Field of Classification Search
CPC ..... B01F 5/0057; F01N 13/08; F01N 3/2892; F01N 2240/20; F01N 2610/20; F01N 2470/18
USPC ..... 366/336
See application file for complete search history.

(56) References Cited

U.S. PATENT DOCUMENTS

| | | | | |
|---|---|---|---|---|
| 2010/0005790 | A1* | 1/2010 | Zhang | F01N 3/36 60/301 |
| 2010/0170233 | A1* | 7/2010 | Tangemann | B01D 53/90 60/299 |
| 2011/0094206 | A1* | 4/2011 | Liu | F01N 3/2066 60/274 |
| 2011/0107749 | A1 | 5/2011 | Tsujimoto et al. | |

FOREIGN PATENT DOCUMENTS

| | | | |
|---|---|---|---|
| DE | 11 2010 002 589 | T5 | 11/2012 |
| DE | 102011108237 | A1 | 1/2013 |
| DE | 10 2013 012 909 | A1 | 2/2015 |
| JP | 2009-30560 | A | 2/2009 |
| JP | 2009-150338 | A | 7/2009 |
| JP | 2011-99415 | A | 5/2011 |
| JP | 2012-021505 | | 2/2012 |
| WO | 2013/104544 | A2 | 7/2013 |

* cited by examiner

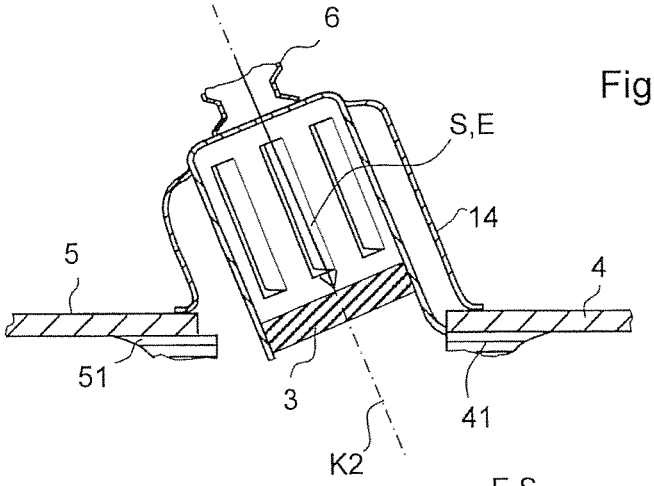
Fig. 5
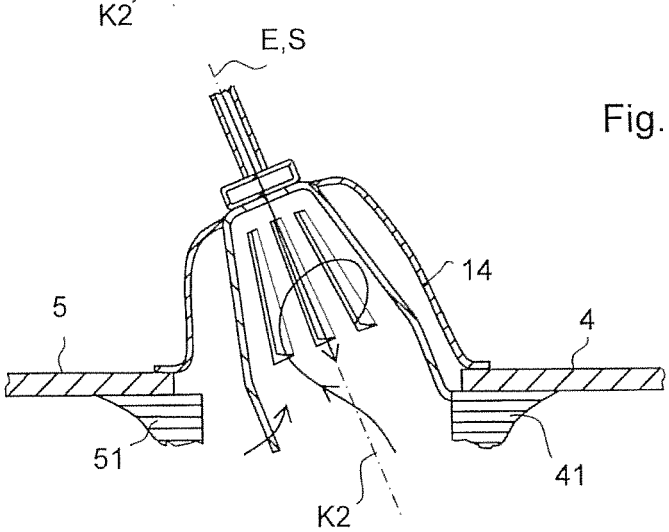
Fig. 6
Fig. 7
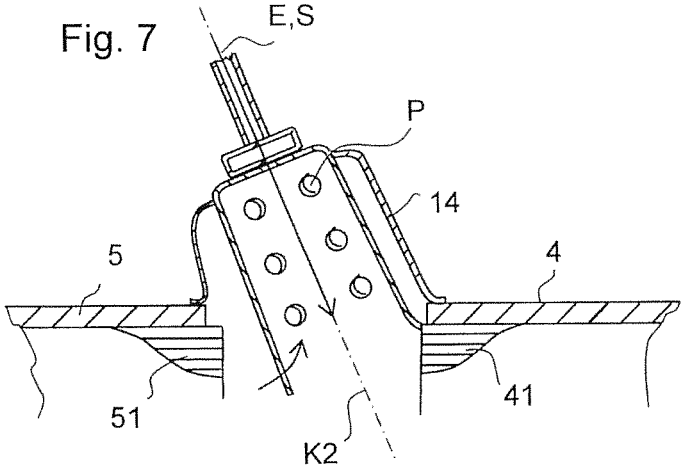

MIXING CHAMBER FOR MIXING AN ADDITIVE IN AN EXHAUST SYSTEM OF AN INTERNAL COMBUSTION ENGINE

FIELD OF THE INVENTION

The invention relates to a mixing chamber for mixing an additive in an exhaust system of an internal combustion engine, comprising a single-part or multi-part housing. To this end, the housing has an entry opening for exhaust gas having a flow cross-section and having a central entry axis, and has, arranged downstream of the entry opening, an exit opening for exhaust gas having a flow cross-section and having a central exit axis. A flow-guiding element is arranged within the housing between the two openings. The flow-guiding element is tubular and has at least one channel which runs in the direction of a channel axis, said channel having a channel wall. The channel wall has at least one inlet and one outlet, via which the entire exhaust gas stream is guided, in a flow direction parallel to the channel axis, to the outlet having an outlet cross-section. The flow direction deviates relative to the central exit axis by an angle a of between 20° and 80°.

BACKGROUND OF THE INVENTION

US 2010/0005790 A1 describes a tubular flow element which deflects the exhaust gas stream at an angle of between 40° and 50° away from the main flow direction, and in which the exhaust gas stream is mixed with an additive. The wall of the flow element is perforated continuously in the flow direction, so that the exhaust gas stream penetrates into the flow element over the entire surface of the wall.

JP 2009 030560 A discloses a mixing device in which a plurality of converters are arranged in the flow-guiding element, which converters help to mix the additive.

US 2011/0094206 A1 describes an injection device in which the additive is injected into the parallel exhaust gas flow.

DE 11 2010 002 589 T5 already describes a mixing chamber arranged between two monoliths (substrates). This mixing chamber is arranged between the monoliths in order to treat the exhaust gases circulating in the exhaust tract. The mixing chamber has a channel, which is formed by a shell and which encloses the central axis, for circulating the exhaust gas stream, said channel being at least 20% longer than the mixing chamber along the central axis.

SUMMARY OF THE INVENTION

The object of the invention is to design and arrange a mixing chamber in such a way that, with a reduced overall length, an improved distribution of the mixture of exhaust gas and additive over the substrate surface is achieved and at the same time deposits of the additive are avoided.

The object is achieved according to the invention in that a downstream substrate is provided adjacent to the outlet in the direction of the central exit axis, the downstream substrate having a substrate cross-section that corresponds to the outlet cross-section. The outlet cross-section and the substrate cross-section differ from one another by at most 8%.

As a result, all the elements of flow of the exhaust gas flowing into the entry opening are deflected by the flow-guiding element in such a way that all the elements of flow are guided out of the mixing chamber by the flow-guiding element in approximately the same flow direction at an angle to the exit opening, a downstream substrate being arranged adjacent to said exit opening. Since the exhaust gas is distributed over the flow cross-section of the exit opening, it is also distributed over the cross-section of the downstream substrate. The downstream substrate is thus exposed to an angled flow, across its entire end face, of elements of flow which are approximately parallel to the flow direction, which leads to a very good distribution of the additive introduced into the mixing chamber, without the additive forming relatively large deposits. Approximately parallel to the flow direction will be understood by a person skilled in the art to mean deviations of at most 5° to 8° from the flow direction defined as the main flow direction. The angle a is preferably between 55° and 75°. At an angle of 65°, a wetting of the substrate with gamma greater than 0.9 was achieved.

In this regard, it may also be advantageous if the outlet has an outlet cross-section running at right angles to the central exit axis, the outlet cross-section being at most 20% smaller than the flow cross-section of the exit opening. The flow-guiding element gathers together all the elements of flow and channels them in the direction of the exit opening, the additive being mixed with the exhaust gas stream in the flow-guiding element.

An advantageous effect is achieved by the fact that the channel wall is connected in flow terms to the downstream substrate directly or indirectly via the outlet cross-section and the distance between the channel wall and/or the downstream substrate is at most 8 mm.

To this end, it is advantageous that the flow-guiding element has, upstream in the direction of the channel axis and opposite the outlet, an inlet having an inlet cross-section, the size of which is 10% to 70% smaller than the outlet cross-section. Besides an adaptation to the respective hydraulic cross-sections of the downstream and upstream substrates, a reduction in size of the inlet cross-section can bring about an acceleration of the exhaust gas stream into the channel, starting at the inlet of the channel, as a result of which the additive introduced in the region of the inlet is mixed better and is reduced in terms of its droplet size.

In particular, it may be advantageous if the channel has, along the channel axis, starting at the central exit axis, a length which corresponds at least to 70% of the quotient of a central radius of the entry opening over sine a, i.e. $L2 \geq {}^{R12}/\sin a$.

As a result, the flow-guiding element almost or completely closes the flow cross-section for the exhaust gas in the direction of the central entry axis and forces said exhaust gas firstly from the axial direction into a radial direction before the exhaust gas flows into the flow-guiding element.

If the cross-sectional area of the upstream substrate is smaller than the flow cross-section of the entry opening by a certain maximum amount, then the channel has a reduced length which corresponds at least to the quotient of a central radius of a substrate over sine a, i.e. $L2 \geq {}^{R51}/\sin a$.

In this case, it is advantageously provided that the housing has a dome protruding beyond the flow cross-section in the radial direction relative to the central entry axis, which dome at least partially forms the channel or into which dome the channel protrudes at least partially. In order that even the outermost element of flow can be deflected into the radial direction, the dome forms a volume outside the radial limits of the rest of the housing.

For the present invention, it may be particularly important that an injection device is arranged on the channel upstream of the inlet in the flow direction, and one or more mixing elements for mixing the additive that is injected into the mixing chamber are arranged adjacent to the inlet and/or in the channel. Regardless of whether the inlet is formed by a single opening or by a plurality of slots or by a perforation, by virtue of which the exhaust gas is swirled as it flows into the channel, mixing elements are provided which are arranged downstream of the injection device.

In connection with the design and arrangement according to the invention, it may be advantageous if an injection device is arranged on the dome or on the flow-guiding element, which injection device introduces the additive into the flow-guiding element in an injection direction, the injection direction being angled by up to 90° relative to the channel axis. By means of a possible angling relative to the channel axis, the additive can be injected in or else counter to the flow direction of the exhaust gas.

With regard to a combination with further parts of an exhaust system, it is advantageous if an upstream converter housing having the upstream substrate is provided upstream of the entry opening, the upstream substrate being connected in flow terms to the inlet. The arrangement is particularly advantageous when the upstream substrate is designed as a catalyst and the downstream substrate is designed as a particle filter.

The basic principle described for mixing the exhaust gas stream with an additive can vary widely with regard to the orientation, so that it is possible that the central entry axis and the central exit axis are arranged parallel or coaxial to one another or intersect one another at an angle b of between 10° and 170°. Examples of embodiments in this regard can be found in the description of the figures.

Due to this versatility, it is advantageous that the entry opening and the exit opening are arranged one behind the other in the direction of the central entry axis or at least partially next to one another in the radial direction relative to the central entry axis. By virtue of this, and by virtue of the above-described variation of the angle, an adaptation to a wide range of installation conditions is ensured. Finally, it may be advantageous if the flow cross-section of the entry opening is a different size in comparison to the flow cross-section of the exit opening.

With regard to the best possible mixing, it is advantageous if the radius of the channel increases continuously from the inlet to the outlet. In this regard, it is advantageous if the channel is enclosed by a channel wall and the channel wall downstream of the inlet or the inlets in the flow direction is closed or is free of perforations or is perforated. Due to a relatively small inlet cross-section of the inlet of the channel in comparison to the outlet cross-section, the flow rate into the channel is increased. Because of this, the mixing of the additive, which is injected at the entrance to the channel, is improved. The subsequent increase in size of the channel cross-section to a cross-section that corresponds to the cross-section of the downstream substrate leads to a distribution of the mixture over the entire substrate. A deflection of all the elements of flow, or of the entire exhaust gas stream, is achieved with a closed channel wall. The inlet and the outlet in this case form the only openings of the flow-guiding element. A perforation of the channel, particularly on the side of the channel oriented toward the entry opening, prevents any swirling and accumulation of the exhaust gas stream in the lower third of the housing, immediately upstream of the channel in the direction of the central entry axis.

The advantages of the described mixing chamber enable it to be combined with a wide range of exhaust systems, with which together a system for internal combustion engines is formed.

Moreover, it may be advantageous if the housing and the downstream converter housing and/or the upstream converter housing form a single-part or multi-part common component.

Furthermore, it may be advantageous if the mixing element is designed as a static mixer having one or more mixing stages.

It may also be advantageous if the mixing chamber or the flow-guiding element or parts thereof are at least partially coated with a catalyst on the sides facing toward the exhaust gas.

BRIEF DESCRIPTION OF THE DRAWINGS

Further advantages and details of the invention are explained in the claims and in the description and are shown in the figures, in which:

FIG. 5 shows an example of embodiment with a mixing element in a flow-guiding element having a slot-shaped inlet;

FIG. 6 shows an example of embodiment with a conical flow-guiding element;

FIG. 7 shows an example of embodiment with a perforated flow-guiding element;

DETAILED DESCRIPTION OF THE INVENTION

Figure 1:
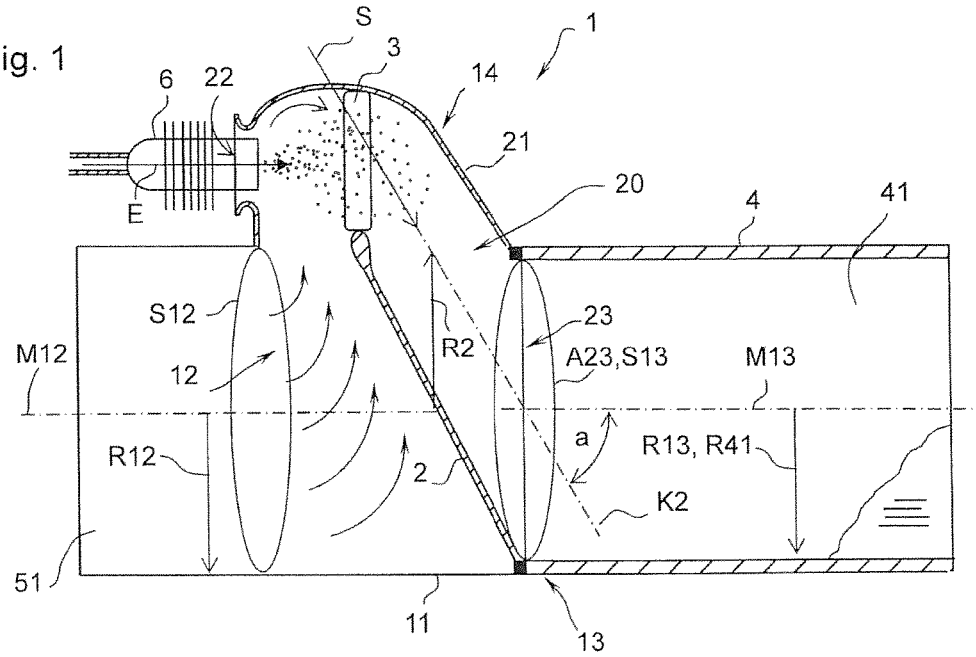
FIG. 1 shows a sectional view of an example of embodiment with an angled injection direction and a substrate on the exit side.
Figure 2:
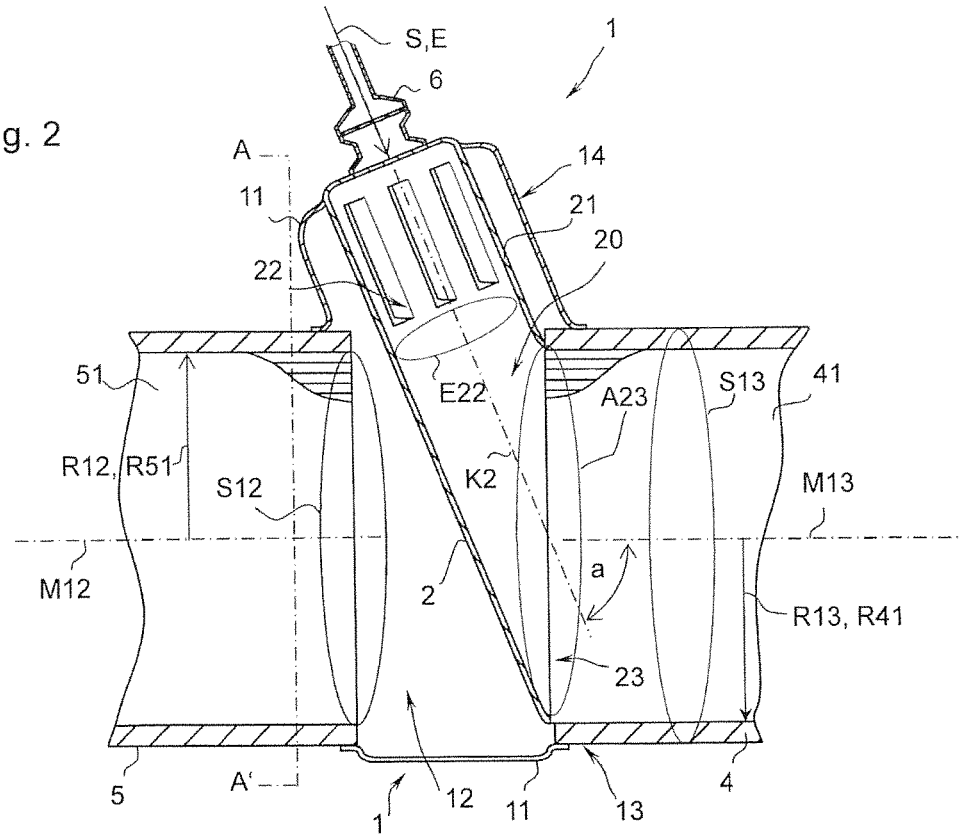
FIG. 2 shows a sectional view of an example of embodiment with a coaxial injection direction and a substrate on both the entry and exit side.

FIGS. 1 and 2 show a mixing chamber 1 which has a housing 11 having an entry opening 12 and an exit opening 13. The entry opening 12 and the exit opening 13 are arranged coaxially in relation to a central entry axis M12 and a central exit axis M13.

A tubular flow-guiding element 2 arranged between the entry opening 12 and the exit opening 13 deflects the exhaust gas stream, after it has entered through the entry opening 12, from an axial direction along the central entry axis M12 into a radial direction because the flow-guiding element 2 blocks an axial flow cross-section S12 toward the exit opening 13.

To this end, the flow-guiding element 2 is designed as a channel 20 having a channel wall 21, and its outlet 23 adjoins an upstream substrate 51 which is mounted in an upstream converter housing 5. Following the radial deflection, the exhaust gas stream is guided via an inlet 22 into the channel 20 and is guided at an angle a of 65° out of the exit opening 13 onto an end face of a downstream substrate In order that as far as possible all the elements of flow are oriented approximately in a flow direction S parallel to a channel axis K2 at the end of the channel 20, the channel 20, or the flow-guiding element 2, has a certain length L2 so that even the outermost element of flow is deflected outward in the radial direction.

Figure 4:
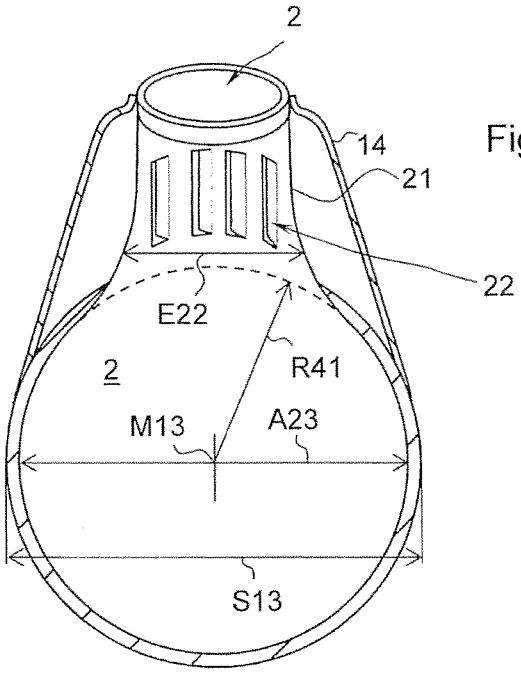
FIG. 4 shows a sectional view counter to the flow direction along the sectional plane A-A'.

The exhaust gas stream deflected in the radial direction gathers in a dome 14 which is formed by a part of the housing 11 that protrudes beyond the entry opening 12 in the radial direction. The inlet 22 of the flow-guiding element 2 is arranged in the dome 14. The inlet 22 is formed by one or more openings in the channel wall 21. The sum of the openings corresponds to an inlet cross-section E22 (FIG. 4). Depending on the embodiment, blades or vanes are provided at the openings and generate a swirl around the channel axis K2. An injection device 6 for injecting an additive in an injection direction E is provided on the dome 14 in the region of the inlet 22.

According to the example of embodiment shown in FIG. 1, the additive is deflected from the injection direction E in the channel 20 in the direction of the channel axis K2. The inlet 22 has an inlet cross-section E22, in which a static mixing element 3 is arranged and through which the additive is injected.

According to the example of embodiment shown in FIG. 2, the injection direction E and the channel axis K2 are coaxial or at least parallel. In FIG. 2, an upstream converter housing 5 is arranged on the housing 11 upstream of the flow-guiding element 2, and a substrate is mounted in said converter housing.

The two converter housings 4, 5 are inserted in the housing 11, in the entry opening 12 and in the exit opening 13. The substrates 41, 51 are arranged coaxial to the central entry axis M12 of the entry opening 12 and to the central exit axis M13 of the exit opening 13.

Figure 3:
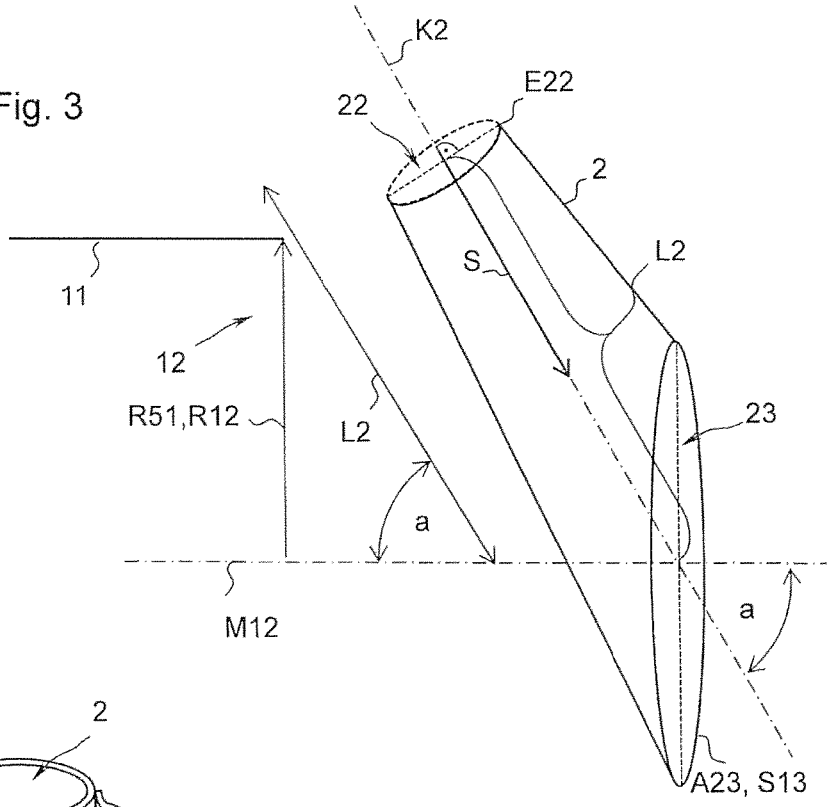
FIG. 3 shows a schematic diagram of the geometric relationships.

The determination of the necessary length L2 is illustrated in the schematic diagram shown in FIG. 3. In order that the entire exhaust gas stream, or every element of flow, can be deflected in the radial direction after entering the entry opening 12, the channel wall 21 of the channel 20 protrudes in the radial direction beyond the central entry axis M12 by an extent that is larger than a radius R12 of the entry opening 1 or a radius R51 of the upstream substrate 51. Taking account of the angle a, by which the channel axis K2 is angled relative to the central exit axis M13, the length L2 must be at least greater than the quotient of the central radius R51 of the substrate 41 over sine a. Depending on how the diameter of the upstream converter housing 5 behaves in relation to the diameter of the upstream substrate 51 or which construction geometry is applied, it may be sufficient that the length L2 is greater than the quotient of the central radius R12 of the entry opening 12 over sine a.

In FIG. 4, the section A-A' according to FIG. 2 is shown without the substrate 51, according to which the curved channel wall 21 is shown, which in the direction of the central exit axis M13 closes the outlet 23 over its entire outlet cross-section A23. The radius of the outlet cross-section A23 corresponds in this case to a radius R41 of the downstream substrate 41. The sum of the openings forming the inlet 22 corresponds to the inlet cross-section E22.

FIG. 5 shows an example of embodiment in which a mixing element 3 is arranged in the channel 20 downstream of the entry opening 12. The entry opening 12 is configured in the manner of a grating, wherein sub-areas of the channel wall 21 are bent inward or outward in the radial direction as a flap in a blade-like manner.

In FIG. 6, the openings are conical. In FIG. 7, a perforation P is provided as the inlet 22 instead of slots, which perforation in sum forms a corresponding inlet cross-section E22.

Figure 8:
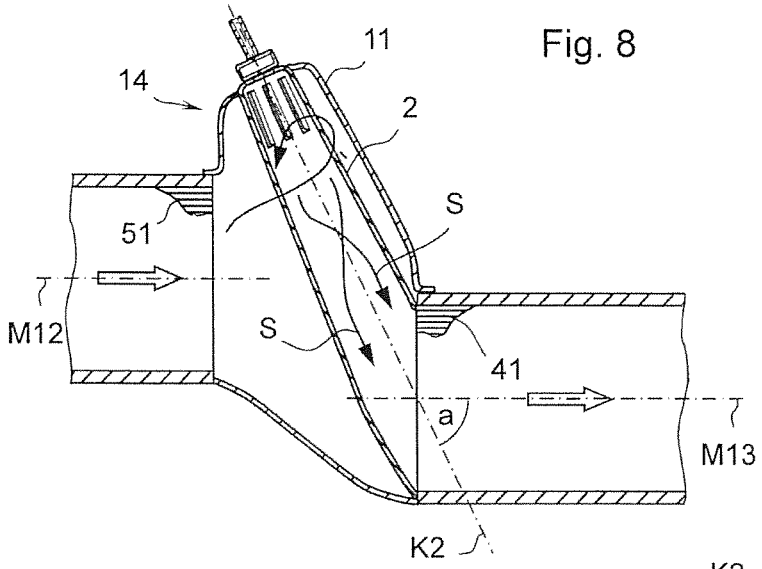
FIG. 8 shows an example of embodiment with substrates arranged parallel to one another and offset from one another.
Figure 9:
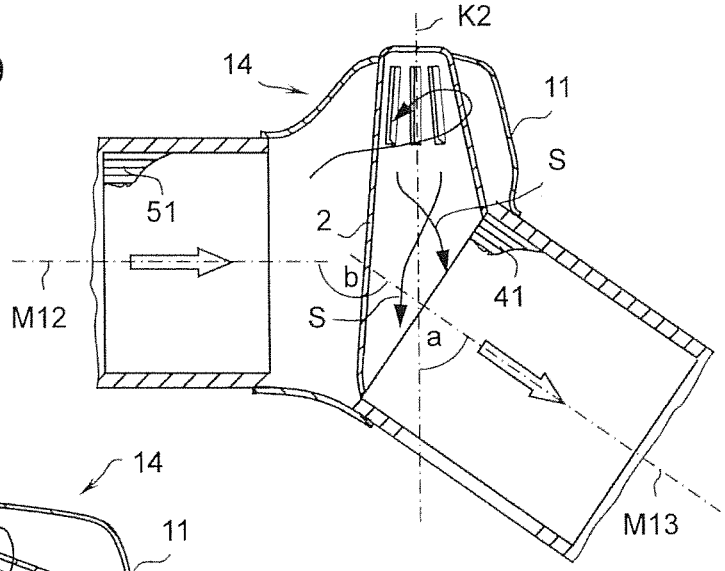
FIG. 9 shows an example of embodiment with substrates arranged at an angle to one another.
Figure 10:
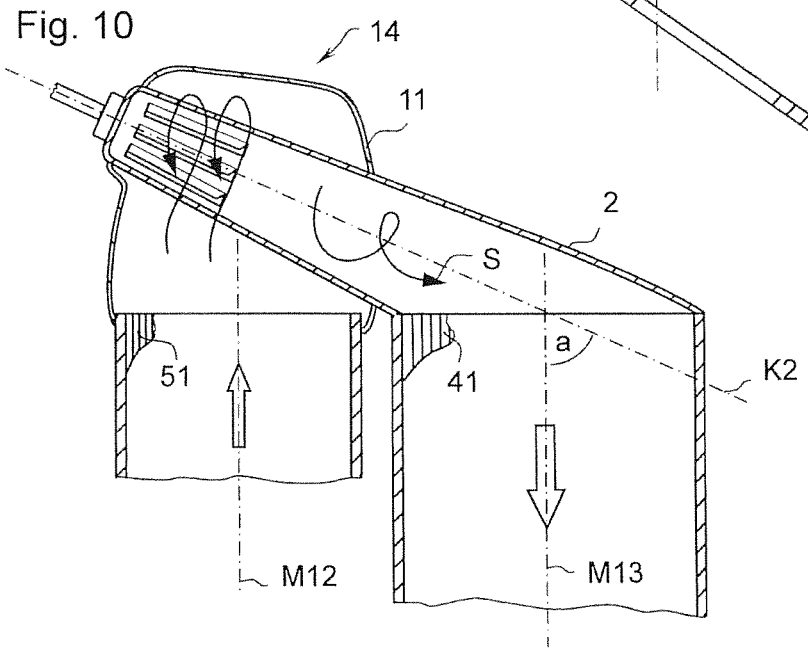
FIG. 10 shows an example of embodiment with substrates arranged parallel to one another and next to one another in the radial direction.

With this mixing principle, the two substrates 41, 51 may be arranged in various positions. In FIG. 8, the two substrates 41, 51 are arranged in an axis-parallel manner so that the central entry axis M12 and the central exit axis M13 are arranged parallel to one another. In FIG. 9, the two substrate central axes are arranged at an angle b of 30° to one another. The angle b may vary between 0° and 180°. 0° corresponds to the example of embodiment shown in FIGS. 1 and 2. 180° corresponds to the example of embodiment shown in FIG. 10.

What is claimed is:

1. A mixing chamber for mixing an additive in an exhaust system of an internal combustion engine, comprising:

a) a single-part or multi-part housing which has an entry opening for exhaust gas having a flow cross-section (S12) and having a central entry axis (M12), and which has, arranged downstream of the entry opening, an exit opening for exhaust gas having a flow cross-section (S13) and having a central exit axis (M13), wherein b) a flow-guiding element is arranged within the housing between the two openings, c) the flow-guiding element is tubular and forms at least one channel having a channel axis (K2), said channel having a channel wall and having at least one inlet and having one outlet formed as an opening by the channel walls of the flow-guiding element, via which the entire exhaust gas stream is guided, in a flow direction (S) parallel to the channel axis (K2), to the outlet having an outlet opening cross-section (A23), wherein d) the flow direction (S) deviates relative to the central exit axis (M13) by an angle a of between 20° and 80°, and wherein a downstream substrate is provided adjacent to the outlet in the direction of the central exit axis (M13), the downstream substrate having a substrate cross-section (S23) that corresponds to the outlet opening cross-section (A23).

2. The mixing chamber according to claim 1, wherein the outlet opening cross-section (A23) runs at right angles to the central exit axis (M13), the outlet opening cross-section (A23) being at most 20% smaller than the flow cross-section (S13) of the exit opening.

3. The mixing chamber according to claim 2, wherein the channel wall is connected in flow terms to the downstream substrate directly or indirectly via the outlet opening cross-section (A23) and the distance between the channel wall and the downstream substrate is at most 8 mm.

4. The mixing chamber according to claim 1, wherein the flow-guiding element has, upstream in the direction of the channel axis (K2) and opposite the outlet, the inlet having an inlet cross-section (E22), the size of which is 10% to 70% smaller than the outlet opening cross-section (A23).

5. The mixing chamber according to claim 1, wherein the channel has, along the channel axis (K2), starting at the central exit axis (M13), a length (L2) which corresponds at least to 70% of a quotient of a central radius (R12) of the entry opening over sine a.

6. The mixing chamber according to claim 1, wherein a substrate is provided upstream of the entry opening and the channel has, along the channel axis (K2), starting at the central exit axis (M13), a length (L2) which corresponds at least to a quotient of a central radius (R51) of a substrate over sine a, i.e. $L2 \geq {}^{R51}/\sin a$.

7. The mixing chamber according to claim 1, wherein the housing has a dome protruding beyond the flow cross-section (S12, S13) in the radial direction relative to the central entry axis (M12), which dome at least partially forms the channel or into which dome the channel protrudes at least partially.

8. The mixing chamber according to claim 1, wherein an injection device is arranged on the channel upstream of the inlet in the flow direction, and one or more mixing elements for mixing the additive that is injected into the mixing chamber are arranged adjacent to the inlet and/or in the channel.

9. The mixing chamber according to claim 7, wherein an injection device is arranged on the dome or on the flow-guiding element, which injection device introduces the additive into the flow-guiding element in an injection direction (E), the injection direction (E) being angled by up to 90° relative to the channel axis (K2).

10. The mixing chamber according to claim 1, wherein an upstream converter housing having an upstream substrate is provided upstream of the entry opening, the upstream substrate being connected in flow terms to the inlet.

11. The mixing chamber according to claim 1, wherein the central entry axis (M12) and the central exit axis (M13) are arranged parallel or coaxial to one another or intersect one another at an angle b of between 10° and 170°.

12. The mixing chamber according to claim 1, wherein the entry opening and the exit opening are arranged one behind the other in the direction of the central entry axis (M12) or at least partially next to one another in the radial direction relative to the central entry axis (M12).

13. The mixing chamber according to claim 1, wherein a radius (R2) of the channel increases continuously from the inlet to the outlet and the channel is enclosed by the channel wall and the channel wall downstream of the inlet(s) in the flow direction is closed or is free of perforations or is perforated.

14. A system consisting of a mixing chamber according to claim 1 and an exhaust system for an internal combustion engine.

15. The mixing chamber according to claim 2, wherein the channel wall is connected in flow terms to the downstream substrate directly or indirectly via the outlet opening cross-section (A23) and the distance between the channel wall and the downstream substrate is at most 8 mm, wherein the flow-guiding element has, upstream in the direction of the channel axis (K2) and opposite the outlet, the inlet having an inlet cross-section (E22), the size of which is 10% to 70% smaller than the outlet opening cross-section (A23), and wherein the channel has, along the channel axis (K2), starting at the central exit axis (M13), a length (L2) which corresponds at least to 70% of a quotient of a central radius (R12) of the entry opening over sine a.

16. The mixing chamber according to claim 15, wherein a substrate is provided upstream of the entry opening and the channel has, along the channel axis (K2), starting at the central exit axis (M13), a length (L2) which corresponds at least to a quotient of a central radius (R51) of a substrate over sine a, i.e. $L2 \geq {}^{R51}/\sin a$, wherein the housing has a dome protruding beyond the flow cross-section (S12, S13) in the radial direction relative to the central entry axis (M12), which dome at least partially forms the channel or into which dome the channel protrudes at least partially, and wherein an injection device is arranged on the channel upstream of the inlet in the flow direction, and one or more mixing elements for mixing the additive that is injected into the mixing chamber are arranged adjacent to the inlet and/or in the channel.

17. The mixing chamber according to claim 16, wherein an injection device is arranged on the dome or on the flow-guiding element, which injection device introduces the additive into the flow-guiding element in an injection direction (E), the injection direction (E) being angled by up to 90° relative to the channel axis (K2), wherein an upstream converter housing having an upstream substrate is provided upstream of the entry opening, the upstream substrate being connected in flow terms to the inlet, and wherein the central entry axis (M12) and the central exit axis (M13) are arranged parallel or coaxial to one another or intersect one another at an angle b of between 10° and 170°.

18. The mixing chamber according to claim 17, wherein the entry opening and the exit opening are arranged one behind the other in the direction of the central entry axis (M12) or at least partially next to one another in the radial direction relative to the central entry axis (M12), and wherein a radius (R2) of the channel increases continuously from the inlet to the outlet and the channel is enclosed by the channel wall and the channel wall downstream of the inlet(s) in the flow direction is closed or is free of perforations or is perforated.

19. A system consisting of a mixing chamber according to claim 18 and an exhaust system for an internal combustion engine.

20. A method for flowing a mixed stream of exhaust gas and an additive over a substrate having a channel structure which is oriented in the direction of a central exit axis (M13), comprising the steps of:

guiding the entire mixed stream of exhaust gas and the additive directly onto the substrate in a flow direction which deviates from the central exit axis (M13) by an angle "a" of between 20° and 80° at an end face of the downstream substrate.

* * * * *